US012246263B2

(12) United States Patent
Bando et al.

(10) Patent No.: US 12,246,263 B2
(45) Date of Patent: Mar. 11, 2025

(54) TOP TOY

(71) Applicant: TOMY COMPANY, LTD., Tokyo (JP)

(72) Inventors: Yohei Bando, Tokyo (JP); Kenji Horikoshi, Tokyo (JP); Makoto Muraki, Tokyo (JP); Takeaki Maeda, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 18/019,204

(22) PCT Filed: Oct. 25, 2022

(86) PCT No.: PCT/JP2022/039611
§ 371 (c)(1),
(2) Date: Feb. 1, 2023

(87) PCT Pub. No.: WO2024/075309
PCT Pub. Date: Apr. 11, 2024

(65) Prior Publication Data

US 2024/0252936 A1 Aug. 1, 2024

(30) Foreign Application Priority Data

Oct. 6, 2022 (JP) ..... 2022-161502

(51) Int. Cl.
*A63H 1/00* (2019.01)
*A63H 1/04* (2006.01)

(52) U.S. Cl.
CPC ..... *A63H 1/04* (2013.01)

(58) Field of Classification Search
CPC ..... A63H 1/00; A63H 1/02; A63H 1/04
USPC ..... 446/256, 257, 259, 264
See application file for complete search history.

(56) References Cited

U.S. PATENT DOCUMENTS 6,626,729 B2 * 9/2003 Osawa ..... A63H 1/00 446/250
9,101,845 B2 * 8/2015 Cai ..... A63H 1/18
9,566,529 B1 * 2/2017 Shindo ..... A63H 1/02
9,849,393 B2 * 12/2017 Muraki ..... A63H 1/00
(Continued)

FOREIGN PATENT DOCUMENTS

JP 5959773 B1 8/2016

*Primary Examiner* — Alexander R Niconovich
(74) *Attorney, Agent, or Firm* — IP Business Solutions, LLC.

(57) ABSTRACT

A top part includes an upper trunk part, and a bottom part including a lower trunk part and first and second rod-shaped shafts. The lower trunk is attached to the upper trunk. The first and second rod-shaped shafts are interchangeable. The first rod-shaped shaft is inserted in an insertion through hole and being attached to the lower trunk. The second rod-shaped shaft is inserted in the insertion through hole and being attached to the lower trunk. When the upper trunk part is rotated and reaches a joint release position, the upper trunk part and the lower trunk part are detached. The bottom part includes first and second engagement part. The first rod-shaped shaft has a first shape to create a first engagement state between the first and second engagement parts. The second rod-shaped shaft has a second shape to create a second engagement state.

7 Claims, 10 Drawing Sheets

(56) References Cited

U.S. PATENT DOCUMENTS

| | | | | |
|---|---|---|---|---|
| 10,029,185 | B2 * | 7/2018 | Cai | A63H 1/18 |
| 10,183,226 | B2 * | 1/2019 | Muraki | A63H 1/02 |
| 10,245,518 | B2 * | 4/2019 | Horikoshi | A63H 1/02 |
| 10,449,438 | B2 * | 10/2019 | Hashiba | A63F 9/16 |
| 10,525,365 | B2 * | 1/2020 | Muraki | A63H 1/02 |
| 10,543,431 | B2 * | 1/2020 | Muraki | A63H 1/04 |
| 10,543,432 | B2 * | 1/2020 | Hashiba | A63H 1/02 |
| 10,556,187 | B2 * | 2/2020 | Horikoshi | A63H 1/00 |
| 10,695,660 | B2 * | 6/2020 | Muraki | A63H 1/00 |
| 11,904,251 | B2 * | 2/2024 | Muraki | A63H 1/00 |
| 11,986,744 | B2 * | 5/2024 | Bando | A63H 1/02 |
| 2009/0253344 | A1 * | 10/2009 | Ujita | A63H 1/02 446/256 |
| 2011/0256795 | A1 * | 10/2011 | Ujita | A63H 1/00 446/264 |
| 2011/0256796 | A1 * | 10/2011 | Ujita | A63H 1/00 446/264 |
| 2016/0228777 | A1 * | 8/2016 | Cai | A63H 1/02 |
| 2018/0236362 | A1 * | 8/2018 | Okutsu | A63H 1/02 |
| 2018/0243660 | A1 * | 8/2018 | Horikoshi | A63H 1/02 |
| 2018/0243661 | A1 * | 8/2018 | Muraki | A63F 9/16 |
| 2018/0339235 | A1 * | 11/2018 | Horikoshi | A63H 1/04 |
| 2019/0134517 | A1 * | 5/2019 | Muraki | A63H 1/04 |
| 2019/0262729 | A1 * | 8/2019 | Horikoshi | A63H 1/04 |
| 2020/0016502 | A1 * | 1/2020 | Horikoshi | A63H 1/02 |
| 2020/0016503 | A1 * | 1/2020 | Horikoshi | A63H 1/02 |
| 2020/0114271 | A1 * | 4/2020 | Muraki | A63H 1/02 |
| 2020/0114273 | A1 * | 4/2020 | Muraki | A63H 1/04 |
| 2020/0129873 | A1 * | 4/2020 | Hama | A63H 1/04 |
| 2020/0269145 | A1 * | 8/2020 | Muraki | A63H 1/18 |
| 2020/0269146 | A1 * | 8/2020 | Muraki | A63H 1/02 |
| 2020/0269147 | A1 * | 8/2020 | Muraki | A63H 1/02 |
| 2023/0211243 | A1 * | 7/2023 | Hama | A63H 1/10 446/259 |
| 2024/0252935 | A1 * | 8/2024 | Bando | A63H 1/02 |

* cited by examiner

TOP TOY

CROSS-REFERENCE TO THE RELATED APPLICATION

This is National Phase Application of PCT Application No. PCT/JP2022/039611 filed on Oct. 25, 2022 which claims priority to Japanese Patent Application No. 2022-161502 filed on Oct. 6, 2022. The entire content of Japanese Patent Application No. 2022-161502 is incorporated herein by reference.

BACKGROUND

Technical Field

The present invention relates to a top toy.

Background Art

Known from the past are top toys comprising a trunk part having a first joining part and a shaft part having a second joining part, configured so that the shaft part and the trunk part for which the center lines are matched to each other are butted against each other from the vertical direction, and by rotating the trunk part relatively in the rotation direction of the top toy with respect to the shaft part, the top surface of the first joining part and the bottom surface of the second joining part are abutted to join the shaft part and the trunk part (see Patent Document 1, for example).

This top toy is used, for example, in a so-called top battle in which two rotating top toys are collided with each other, and the side whose top toy is disassembled first loses.

PRIOR ART DOCUMENTS

Patent Document 1: Japanese Patent No. 5959773

SUMMARY

Problems the Invention is Intended to Solve

According to the abovementioned top toy, by colliding top toys with each other, by rotating the trunk part relatively in the direction opposite to the rotation direction of the top toy with respect to the shaft part, the top toy is disassembled by releasing the abutting of the top surface of the first joining part and the bottom surface of the second joining part.

The difficulty in disassembling in this case depends on the rotational resistance that occurs between the trunk part and the shaft part. For that reason, rotational resistance is provided between the trunk part and the shaft part to adjust the difficulty of disassembly.

However, the provided rotational resistance is fixed, and to change the rotational resistance, though not a known technology yet, the only option was to change the combination of the sliding contact parts by changing the trunk part having the first joining part or the shaft part having the second joining part. In this case, changing the rotational resistance is a major endeavor.

Taking these circumstances into consideration, the purpose of the present invention is to provide a top toy in which adjusting the difficulty of disassembly can be done easily by exchanging a rod-shaped shaft.

Means for Solving the Problems

A top part includes an upper trunk part, and a bottom part including a lower trunk part and first and second rod-shaped shafts.

The lower trunk part has an insertion through hole formed at a center thereof. The lower trunk is attached to the upper trunk.

The first and second rod-shaped shafts are interchangeable to each other.

When the first rod-shaped shaft is employed, the first rod-shaped shaft is inserted in the insertion through hole and being attached to the lower trunk.

When the second rod-shaped shaft is employed, the second rod-shaped shaft is inserted in the insertion through hole and being attached to the lower trunk.

When the upper trunk part is rotated relative to the lower trunk part in a second direction opposite to the first direction by an external force and when reaches a joint release position, the upper trunk part and the lower trunk part are detached.

The bottom part includes a first engagement part, and a second engagement part being engaged with the first engagement part at a part that rotates integrally with the upper trunk part.

The first rod-shaped shaft has a first shape to create a first engagement state between the first and second engagement parts.

The second rod-shaped shaft has a second shape being different from the first shape to create a second engagement state between the first and second engagement parts. The first engagement state is different from the second engagement state.

DETAILED DESCRIPTION OF PREFERRED EMBODIMENTS

First Embodiment

Figure 1:
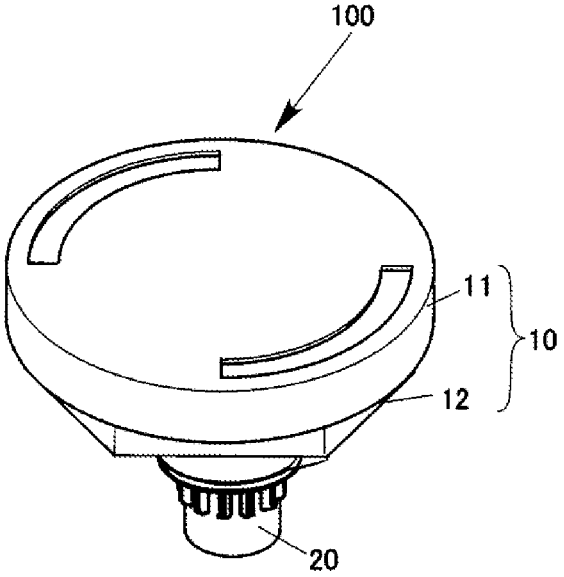
FIG. 1 is a perspective view of a top toy of a first embodiment.
Figure 2:
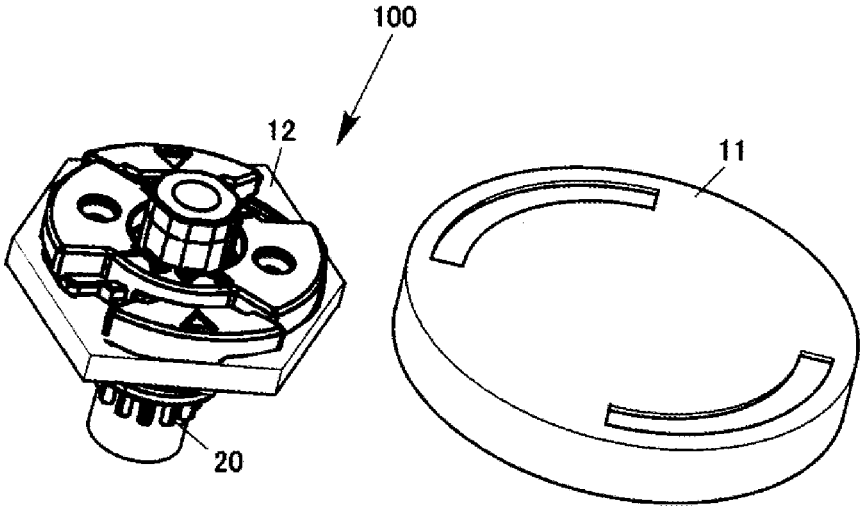
FIG. 2 is a perspective view showing the top toy disassembly state during a top battle.

FIG. 1 is a perspective view of a top toy 100 of an embodiment, and FIG. 2 is a perspective view showing the disassembled state of the top toy 100 during a top battle.

This top toy 100 is used in top battles in which top toys 100 are collided with each other to fight. This top toy 100 comprises a trunk part 10 configured including an upper trunk part 11 and a lower trunk part assembly 12 (lower trunk part), and a shaft 20 having a rod shape (rod-shaped shaft). The upper trunk part constitutes a top part 101. The lower trunk part 12 and a shaft 20 constitute a bottom part 102. As shown in FIG. 2, as a result of the top battle, this top toy 100 can be disassembled into to two parts, the upper trunk part 11, and the lower trunk part assembly 12 and the shaft 20. Also, by exchanging the shaft 20, it is possible to change the level of difficulty of disassembling the top toy 100 (rotational resistance) during top battles.

Top Toy 100

Figure 3:
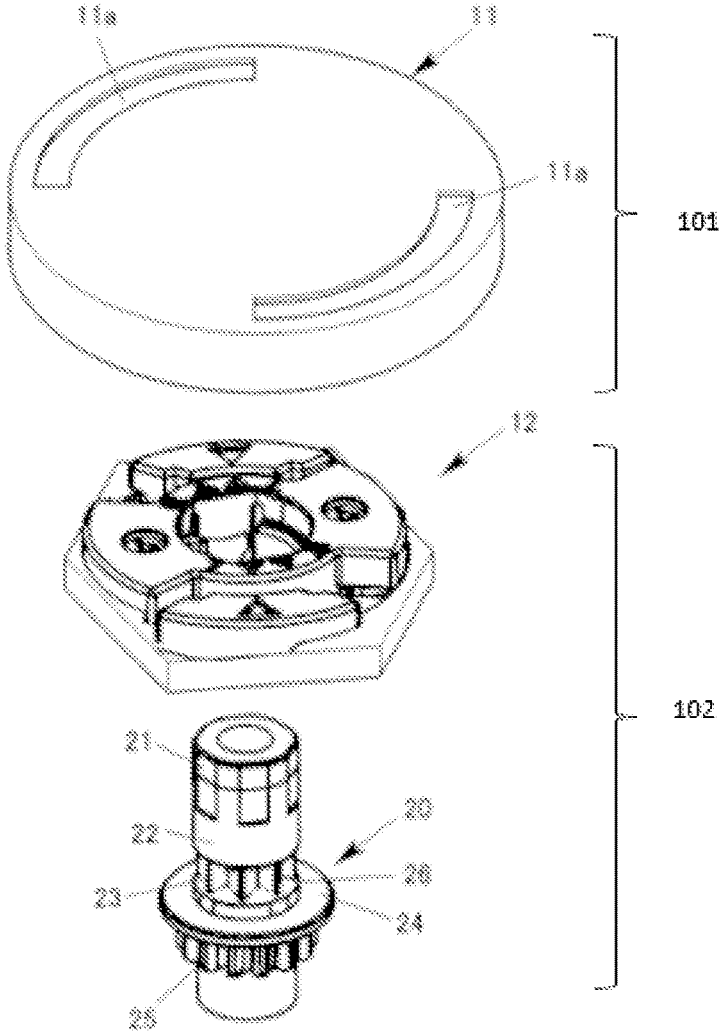
FIG. 3 is an exploded perspective view of the top toy.

FIG. 3 is an exploded perspective view of the top toy 100.

The top toy 100 comprises the trunk part 10 and the shaft 20, and is constituted mostly from plastic.

Upper Trunk Part 11

Figure 4:
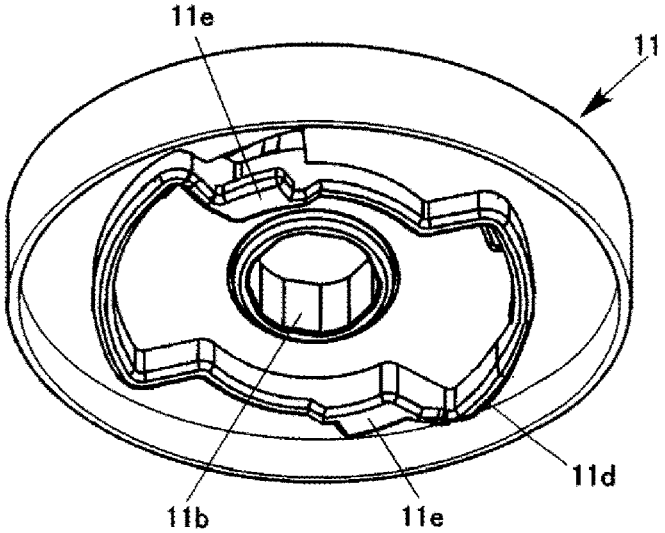
FIG. 4 is a perspective view of an upper trunk part seen from below.

FIG. 4 is a perspective view of the upper trunk part 11 seen from below.

Though not particularly limited, the upper trunk part 11 is a composite configured by assembling a plurality of components. The upper trunk part 11 includes a flywheel made of metal, for example.

Though not particularly limited, the top surface of the upper trunk part 11 is flat. Inside of the outer periphery of this top surface, two arc-shaped grooves 11*a* that extend concentrically with the shaft 20 are formed at prescribed intervals in the circumferential direction. However, the number is not limited to being two. The arc-shaped grooves 11*a* are used when the top toy 100 is rotationally energized.

At the lower side center of the upper trunk part 11, a fitting hole 11*b* that is a polygon, for example, is formed for fitting a shaft head 21 of the shaft 20. The fitting hole 11*b* is not limited to being a polygon, and may also be a circular hole. The part (cylindrical portion) forming this fitting hole 11*b* is rotatable around the shaft 20 with respect to the upper trunk part 11. Furthermore, on the lower side of the upper trunk part 11, a butterfly-shaped fitting wall 11*d* is erected to surround the fitting hole 11*b*. At least a portion of an upper plate 14 (see FIG. 5) is fitted in the fitting wall 11*d*. On the outside of this fitting wall 11*d*, a joining piece 11*e* that is used when joining the upper trunk part 11 with the lower trunk part assembly 12 is formed.

This upper trunk part 11 is for clockwise rotation, but by changing the formation position of the joining piece 11*e*, it can be for counterclockwise rotation.

Lower Trunk Part Assembly 12

Figure 5:
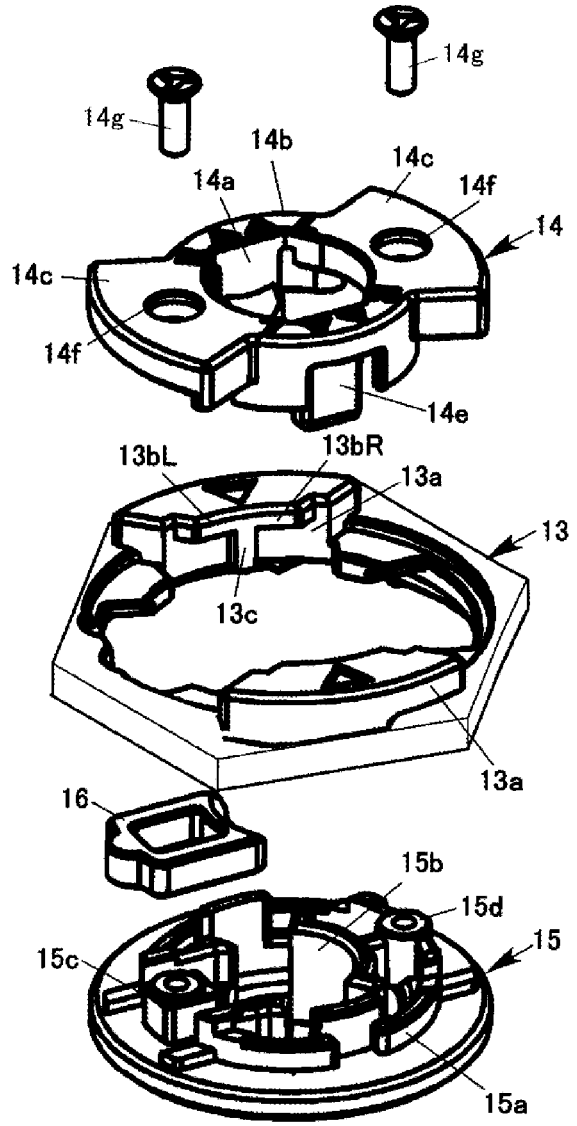
FIG. 5 is an exploded perspective view of a lower trunk part assembly.

FIG. 5 is an exploded perspective view of the lower trunk part assembly 12.

The lower trunk part assembly 12 comprises a ring-shaped body 13 constituting the lower trunk part, and the upper plate 14 and a lower plate 15 that grip the ring-shaped body 13 from above and below. The upper plate 14 and the lower plate 15 constitute a support body for the ring-shaped body 13, and support the ring-shaped body 13 to be rotatable around the shaft 20. The upper plate 14 and the lower plate 15 constitute the support body of the ring-shaped body 13, and normally rotate integrally with the upper trunk part 11.

The ring-shaped body 13 is hexagonal in the plan view. The shape of the ring-shaped body 13 is not limited to this, and it is sufficient that it be a shape that can receive an external impact during a top battle, and preferable to have undulations provided on the outer periphery.

Standing walls 13*a* that extend in an arc shape along the circumferential direction are provided at two locations facing opposite sandwiching the center line on the top surface of the ring-shaped body 13, and joining pieces 13*b*L, 13*b*R that overhang inward in an eave shape are formed on each standing wall 13*a*.

A partition 13*c* is formed standing upright between the joining pieces 13*b*L, 13*b*R. These joining pieces 13*b*L, 13*b*R selectively engage with the joining piece 11*e* of the upper trunk part 11. Specifically, the joining piece 13*b*L is the joining piece used when the top toy 100 is rotated counterclockwise, and the joining piece 13*b*R is the joining piece used when rotating the top toy 100 clockwise. The lower trunk part assembly 12 of this embodiment is used for both rotations (for clockwise rotation and for counterclockwise rotation). Specifically, by exchanging the upper trunk part 11, it is possible to change the top toy 100 to be for clockwise rotation or for counterclockwise rotation.

Figure 6:
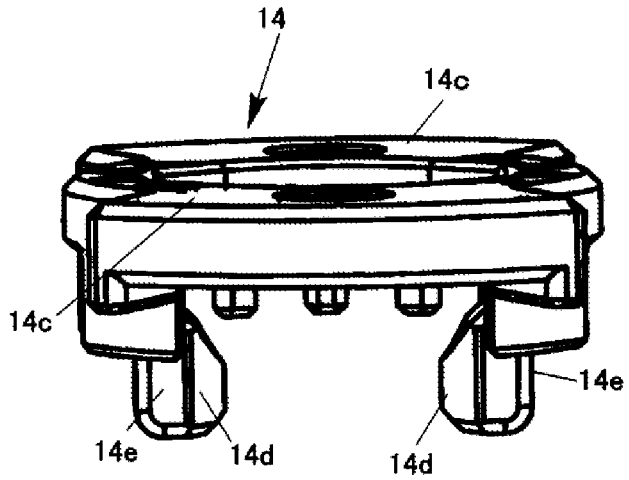
FIG. 6 is a perspective view of an upper plate.

Crescent-shaped recesses (first engagement part) 13*d*, 13*e* in which a convex part (second engagement part) 16*b* that is crescent-shaped in the plan view of a movable member 16 described later is fitted are provided adjacent on the inner periphery of the ring-shaped body 13. A convex part 13*f* is formed between the recesses 13*d*, 13*e*. Here, the recess 13*d* is fitted on the convex part 16*b* described later in a state with the top toy 100 for clockwise rotation assembled, and the recess 13*e* is fitted on the convex part 16*b* described later in a state with the top toy 100 for counterclockwise rotation assembled. FIG. 6 is a perspective view of the upper plate 14.

The upper plate 14 has a core body 14*b* that is circular in the plan view on which is formed an insertion through hole 14*a* through which the shaft 20 is inserted, and overhang parts 14*c*, 14*c* that are fan-shaped in the plan view and overhang from the core body 14*b* in a direction away from each other.

On the lower side of the core body 14*b*, elastic pieces 14*e* protruding facing downward with an inward facing claw 14*d* formed on the tip are provided respectively at two locations facing opposite sandwiching the center line. The two elastic pieces 14*e*, 14*e* constrict and swell by elasticity in the radial direction of the core body 14*b*.

Meanwhile, a counterbore hole 14*f* is formed on the overhang part 14*c*. Each overhang part 14*c* is arranged between the two standing walls 13*a*, 13*a* of the ring-shaped body 13. Each overhang part 14*c* can move between the two standing walls 13*a*, 13*a* centered around the shaft 20.

A guide wall 15*a* that fits inside of the ring-shaped body 13 and guides the rotation of the ring-shaped body 13 in sliding contact is erected on the top surface of the lower plate 15. An insertion through hole 15*b* of the shaft 20 is formed inside the guide wall 15*a*. Female threaded bosses 15*c*, 15*d* are erected on the top surface of the lower plate 15 at two locations facing opposite sandwiching the center line.

Figure 7:
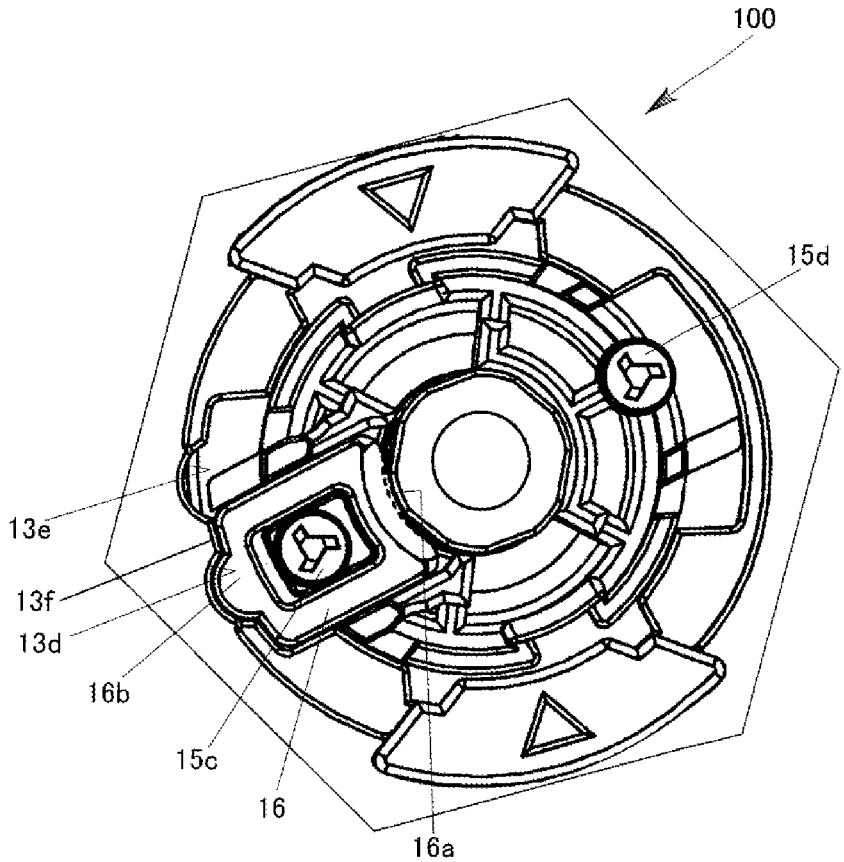
FIG. 7 is a plan view of the top toy in a state with the upper trunk part and the upper plate removed.

FIG. 7 is a plan view of the top toy 100 in a state with the upper trunk part 11 and the upper plate 14 removed.

One boss 15*c* is a rectangular projection in the plan view, and the hollow movable member 16 that has a rectangular frame shape in the plan view is externally fitted on this boss 15*c*. Though not particularly limited, the movable member 16 is constituted from POM (PolyOxyMethylene), for example. The length dimension in the radial direction of the hollow part is greater than the length dimension in the radial direction of the boss 15*c*, and the movable member 16 can move within a prescribed range in the radial direction. An arc-shaped part 16*a* is formed inside the movable member 16, and can abut the outer periphery of the shaft 20. Meanwhile, the convex part 16*b* that is crescent shaped in the plan view is formed on the outside of the movable member 16. The convex part 16*b* is fitted in one of the recesses 13*d*, 13*e* of the inner periphery of the ring-shaped body 13 according to the rotation position with respect to the lower plate 15 of the ring-shaped body 13. The depth dimension of the recesses 13*d*, 13*e* is set to a level such that the convex part 16*b* does not come out from the recesses 13*d*, 13*e* even then the movable member 16 moves radially inward. However, when an external force of a prescribed size acts between the ring-shaped body 13 and the support body, the ring-shaped body 13 undergoes elastic deformation by mutual sliding contact, the convex part 16*b* comes out from the recesses 13*d*, 13*e* (goes over a convex part 13*f*), and the ring-shaped body 13 and the support body rotate relative to each other.

In a state with the ring-shaped body 13 sandwiched by the upper plate 14 and the lower plate 15, male screws 14*g* that go through the counterbore holes 14*f* of the upper plate 14 are screwed into female threaded bosses 15*c*, 15*d*.

Shaft 20

Figure 8:
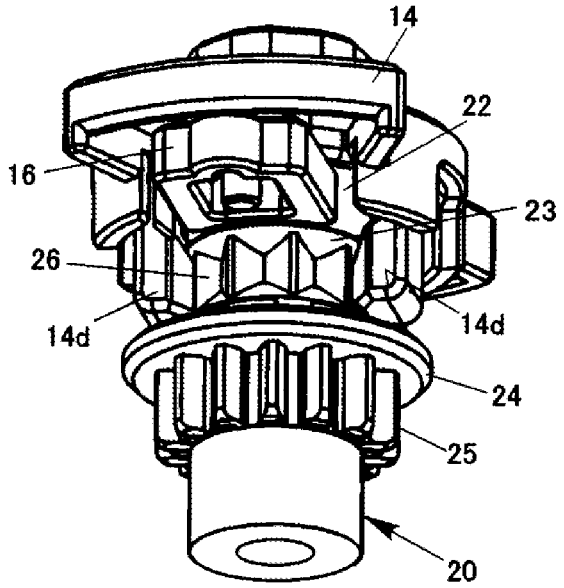
FIG. 8 is a perspective view showing a shaft and its periphery.

FIG. 8 is a perspective view showing the shaft 20 and its periphery. In the drawing, the ring-shaped body 13 and the lower plate 15 are omitted.

The shaft 20 is configured to be rod-shaped. The shaft head 21 of the shaft 20 (see FIG. 3) has a complementary shape to the fitting hole 11*b* of the upper trunk part 11, that is, is a polygon. This shaft head 21 fits in the fitting hole 11*b* of the upper trunk part 11, and as a result, the shaft 20 is able to rotate integrally with the fitting hole 11*b* forming part (fitted part).

Also, below the shaft head 21 is an abutted part 22 with which the arc-shaped part 16*a* of the movable member 16 can abut. As a result, rotational resistance is formed between the ring-shaped body 13 and the shaft 20.

Furthermore, a constricted part 23 is formed below the abutted part 22, and the claw 14*d* of the upper plate 14 is engaged with this constricted part 23. The constricted part 23 is an example of a third engagement part. As a result, the shaft 20 is picked up and held by the claw 14*d*. Gears 26 are formed on the constricted part 23, and the claw 14*d* meshes with the gears 26.

Below the constricted part 23, a flange part 24 is formed that overhangs radially outward along the entire circumference.

This flange part 24 contacts the bottom surface of the lower plate 15 when the shaft 20 is inserted from below in the insertion through holes 15*b*, 14*a* of the lower trunk part assembly 12. A tapered part that becomes narrower facing upward is provided on this flange part 24, and as a result, when the shaft 20 is inserted in the insertion through hole 15*b* of the lower plate 15, the shaft 20 may be securely held in the center.

Below the flange part 24, gears 25 that mesh with teeth 93*a* of a battle stadium 90 described later are formed.

Assembly Method

Figure 9:
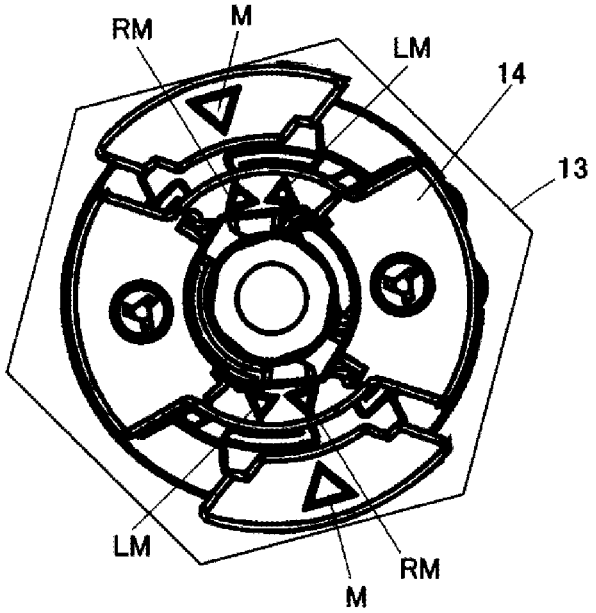
FIG. 9 is a plan view of the top toy in a state with the upper trunk part removed.
Figure 10:
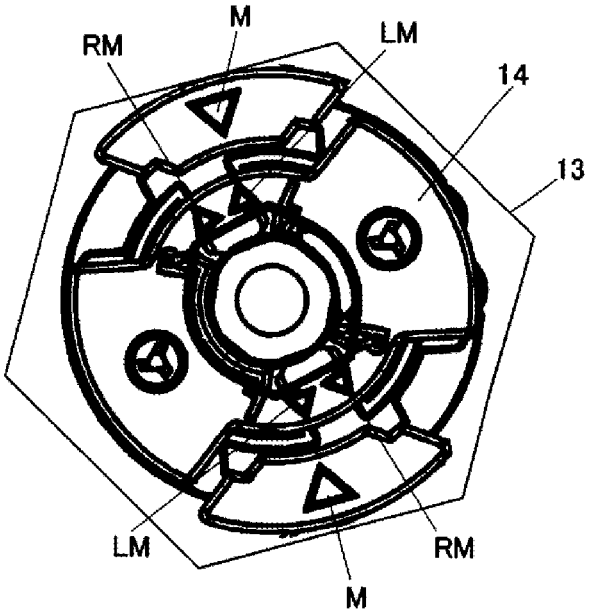
FIG. 10 is a plan view of the top toy in a state with the upper trunk part removed.

FIG. 9 and FIG. 10 are plan views of the top toy 100 in a state with the upper trunk part 11 removed.

First, since the upper trunk part 11 is for clockwise rotation, the upper plate 14 and the ring-shaped body 13 are rotated relative to each other to align the triangle mark RM on the "R" character side on the upper plate 14 with the triangle mark M on the ring-shaped body 13 (FIG. 9). At this time, the convex part 16*b* of the movable member 16 is fitted into the recess 13*e* of the inner periphery of the ring-shaped body 13.

In this state, the upper plate 14 is aligned with the fitting wall 11*d* of the upper trunk part 11, and the upper trunk part 11 and the lower trunk part assembly 12 are butted against each other. As a result, a portion of the upper plate 14 is fitted into the fitting wall 11*d*.

In this state, the ring-shaped body 13 is rotated relatively clockwise with respect to the upper trunk part 11. At this time, the upper plate 14 rotates relatively counterclockwise together with the upper trunk part 11 with respect to the ring-shaped body 13, and the triangle mark LM on the upper plate 14 is aligned with the triangle mark M on the ring-shaped body 13 (FIG. 10). As a result, the bottom surface of the joining piece 13*b*R of the ring-shaped body 13 abuts the top surface of the joining piece 11*e* of the upper trunk part 11, joining the lower trunk part assembly 12 and the upper trunk part 11. Also, the convex part 16*b* of the movable member 16 goes over the convex part 13*f* and is fitted in the recess 13*d*.

After that, the shaft 20 is inserted from below in the trunk part 12 and the shaft head 21 is fitted in the fitting hole 11*b*. As a result, the shaft 20 is picked up and held by the claw 14*b*, and the claw 14*d* meshes with the gears 26. However, by pulling the shaft 20 downward, it is possible to easily remove it from the lower trunk part assembly 12. By doing the above, the top toy 100 is assembled.

When the top toy 100 is for rotating counterclockwise, first, the triangle mark LM of the "L" character side on the upper plate 14 is aligned with the triangle mark M on the ring-shaped body 13, and the lower trunk part assembly 12 is joined with the upper trunk part 11. The relative rotation direction during assembly in this case is the opposite to the case described above.

Top Toy 100 Disassembly

In a top battle, when the other top toy contacts the ring-shaped body 13 and an external force acts on the ring-shaped body 13 in the direction opposite to the rotation direction of the top toy 100, while the rotation of the ring-shaped body 13 stops, the upper trunk part 11 and the support body continue rotating due to inertial force. As a result, the ring-shaped body 13 rotates relatively counterclockwise in relation to the support body, and by sliding contact, the convex part 16*b* separates from the recess 13*d* of the inner periphery of the ring-shaped body 13 (goes over the convex part 13*f*) and fits into the recess 13*e*.

In this position, the joining piece 13*b*R of the ring-shaped body 13 separates from the joining piece 11*b* of the upper trunk part 11, disassembling into two pieces, the upper trunk part 11, and the lower trunk part assembly 12 and the shaft 20.

When the top toy 100 is for counterclockwise rotation, the relative rotation direction during disassembly is opposite to the case described above.

Top Shooting Device 80

Figure 11:
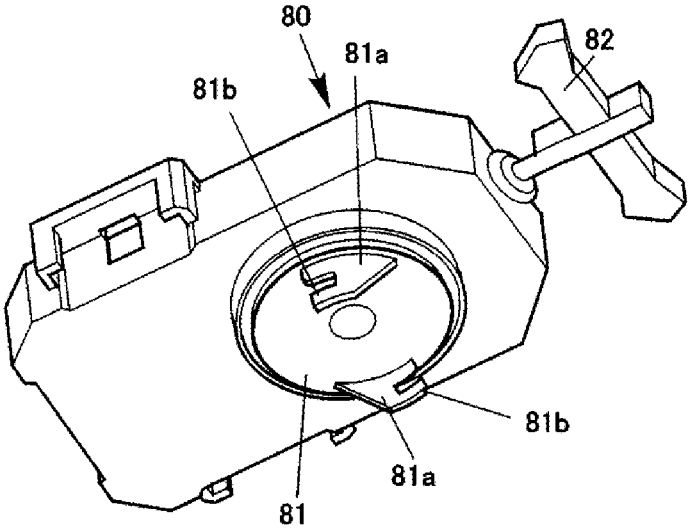
FIG. 11 is a perspective view showing a perspective view showing the top shooting device.

FIG. 11 is a perspective view showing a top shooting device 80.

The top shooting device 80 comprises a top holder 81 that holds the rotationally energized top toy 100. The top holder 81 is provided with the same number of insertion pieces 81*a* corresponding to the arc-shaped grooves 11*a* of the top toy 100. A locking part 81*b* that projects in the rotationally energized direction is formed on the insertion piece 81*a*. After the insertion piece 81*a* is inserted in the arc-shaped groove 11*a* of the top toy 100, the top toy 100 is rotated relatively in the direction opposite to the rotationally energized direction of the top toy 100 with respect to the top holder 81, and by the locking part 81*b* getting under the edge wall of one end part of the arc-shaped groove 11*a*, the top toy 100 is attached to the top holder 81.

A handle 82 is provided on the top shooting device 80. One end of a cord (not illustrated) is attached to this handle 82. The cord is wound on an input rotor (not illustrated) by the restoring force of a mainspring, and by operating the handle 82 to pull the cord, rotational force is inputted to the input rotor. The input rotor is coupled to the top holder 81, which is rotated by the rotation of the input rotor.

With this top shooting device 80, the top toy 100 attached to the top holder 81 is rotationally energized by rotating the top holder 81 by operating the handle 82. When operation of the handle 82 is stopped, while rotation of the top holder 81 stops, the top toy 100 continues rotating due to inertial force, so the locking part 81*b* comes out from under the edge wall of one end part of the arc-shaped groove 11*a*, and is pushed out by sliding contact with the inclined surface of the back of the insertion piece 81*a*, and the top toy 100 is shot.

Here, the input rotor coupled to the top holder 81 was rotated using a cord, but it is also possible to use a gear for the input rotor coupled to the top holder 81, with the gear rotated by a rack belt having a belt part on which a rack is formed.

Battle Stadium 90

Figure 12:
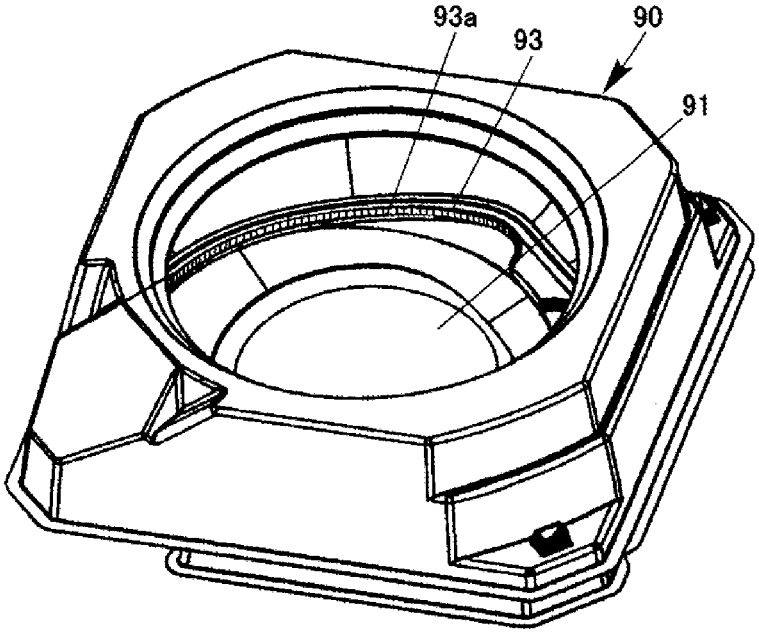
FIG. 12 is a perspective view showing the external appearance of a battle stadium.

FIG. 12 is a perspective view showing the external appearance of the battle stadium 90.

The bottom surface of a field 91 of the battle stadium 90 is a concave curved surface, and the field 91 is covered by a transparent cover 92 with an open center. A guide section 93 on which are formed teeth 93*a* that mesh with the gears 25 of the shaft 20 of the top toy 100 that moves around inside the field 91 is arranged in the field 91.

With this battle stadium 90, by meshing the teeth 93*a* with the gears 25 of the shaft 20 of the top toy 100, the top toy 100 is rolled with respect to the guide section 93, and it is possible to increase the speed at which the top toy 100 moves around.

Types of Shaft 20

As the shaft 20, four types of shafts 20A to 20D shown in FIG. 13A to 13D are prepared, for example.

1. Shaft 20A

Figure 14A:
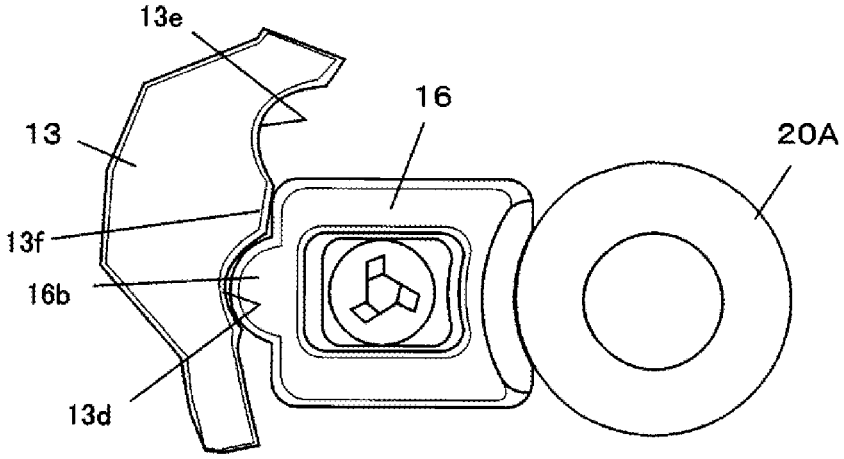
FIG. 14A is a plan view showing the degree of fitting between a convex part of a movable member and a recess of a ring-shaped body.

The shaft 20A is similar to the shaft 20. With this shaft 20A, the shaft diameter of an abutted part 22A is the same diameter as that of a shaft head 21A (large diameter). With this shaft 20A, in a state with the arc-shaped part 16*a* on the inside of the movable member 16 abutting the abutted part 22A of the shaft 20A, as shown in FIG. 14A, the convex part 16*b* and the recess 13*d* are fitted deeply and the rotational resistance becomes greater. Therefore, for the ring-shaped body 13, the ring-shaped body 13 does not rotate easily with respect to the upper trunk part 11 or the support body. As a result, the top toy 100 is not disassembled easily.

Gears 26A are formed inside a constricted part 23A. The gears 26A mesh with the claw 14*b*, so the shaft 20 easily rotates integrally with the upper trunk part 11. As a result, when the gears 25A mesh with teeth 93*a* of the guide section 93, it is easier for the rotational force of the upper trunk part 11 to be transmitted to the guide section 93, and since the teeth 93*a* receive a strong kick, the movement accelerates easily.

The tip of the shaft 20A is flat, so it is easy to move around a lot.

2. Shaft 20B

Figure 14B:
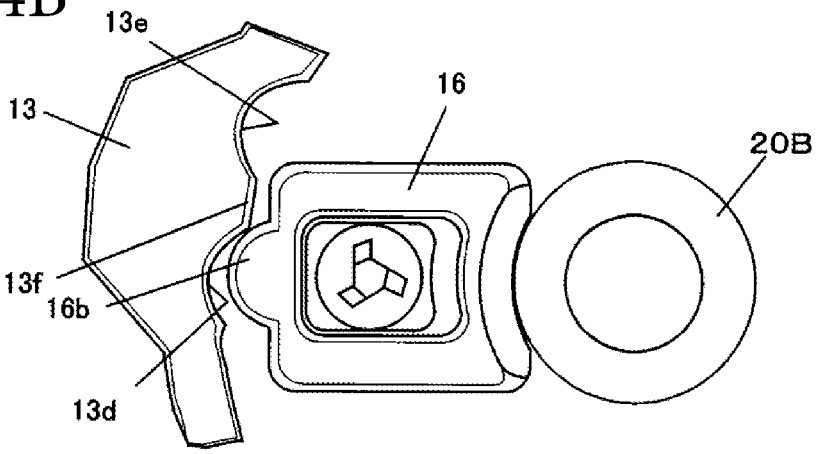
FIG. 14B is a plan view showing the degree of fitting between the convex part of the movable member and the recess of the ring-shaped body.
Figure 15:
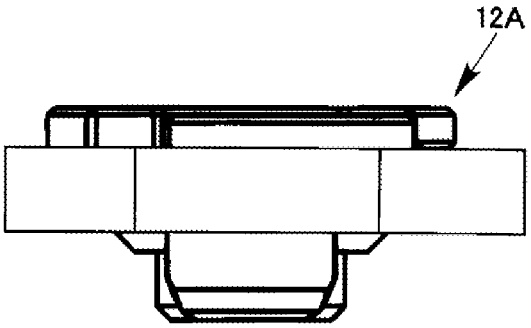
FIG. 15 is a front view of a modification example of the lower trunk part assembly.

In a shaft 20B, the shaft diameter of an abutted part 22B is a medium diameter. With this shaft 20B, in a state with the arc-shaped part 16*a* on the inside of the movable member 16 abutting the abutted part 22B of the shaft 20B, as shown in FIG. 14B, the convex part 16*b* and the recess 13*d* are fitted at a medium level. Therefore, compared to the shaft 20A, the ring-shaped body 13 has a smaller rotational resistance with respect to the upper trunk part 11 and the support body, and rotates a little more easily.

There are no gears inside a constricted part 23B. Therefore, slipping occurs between the constricted part 23*b* and the claw 16*b*, so compared to the shaft 20A, while the rotational force of the upper trunk part 11 isn't transmitted easily to the guide section 93, it is less likely to be repelled by the guide section 93, making movement along the guide section 93 easier.

The diameter of the tip of the shaft 20B is smaller than that of the shaft 20A, and a taper is formed making it semi-flat, so the top toy 100 moves around though not as much as with the shaft 20A.

3. Shaft 20C

In a shaft 20C, the shaft diameter of an abutted part 22C is a small diameter. With this shaft 20C, in a state with the arc-shaped part 16*a* on the inside of the movable member 16 abutting the abutted part 22C of the shaft 20C, the convex part 16*b* and the recess 13*d* are fitted more shallowly than the shaft 20B. Therefore, the ring-shaped body 13 rotates even more easily in relation to the upper trunk part 11 and the support body than in the case of the shaft 20B.

There are no gears inside a constricted part 23C. Therefore, slipping occurs between the constricted part 23*b* and the claw 16*b*, so compared to the case of the shaft 20A, while the rotation of the upper trunk part 11 is not easily transmitted to the guide section 93, it is less likely to be repelled by the guide section 93, making movement along the guide section 93 easier.

A small projection is formed on the tip of the shaft 20C. As a result, the top toy 100 spins longer than in the case of the shaft 20A. The surface on which the small projection of the shaft 20C is formed is flat, so the top toy 100 does not fall over easily even if it tilts.

4. Shaft 20D

In a shaft 20D, the shaft diameter of an abutted part 22D is a small diameter. With this shaft 20D, in a state with the arc-shaped part 16*a* inside the movable member 16 abutting the abutted part 22D of the shaft 20D, the convex part 16*b* and the recess 13*d* are fitted even more shallowly than the case of the shaft 20B. Therefore, the ring-shaped body 13 rotates even more easily with respect to the upper trunk part 11 and the support body than in the case of the shaft 20B.

There are no gears inside the constricted part 23D. Therefore, slipping occurs between the constricted part 23*b* and the claw 16*b*, so compared to the case of the shaft 20A, while the rotation of the upper trunk part 11 is not easily transmitted to the guide section 93, it is less likely to be repelled by the guide section 93, making movement along the guide section 93 easier.

The tip of the shaft 20D is hemispherical. As a result, though not as much as the case of the shaft 20A, the top toy 100 moves around a lot.

Modification Example of Lower Trunk Part Assembly 12 and Shaft 20

Figure 16:
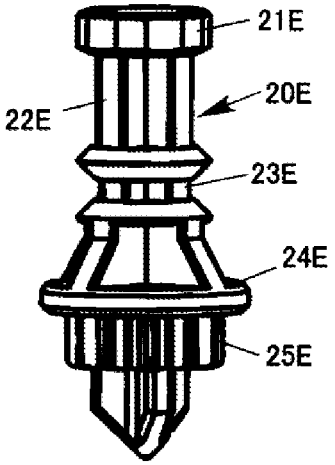
FIG. 16 is a front view showing an example of a shaft attached to the movable part of FIG. 15.

This lower trunk part assembly 12A has a thickness greater than that of the lower trunk part assembly 12 noted above. Other than this point, the lower trunk part assembly 12A has the same configuration as that of the lower trunk part assembly 12 noted above. A shaft 20E attached to this lower trunk part assembly 12A is shown in FIG. 16. This shaft 20E is taller in height than the abovementioned shafts 20A to 20D.

In the shaft 20E, an abutted part 22E has a small diameter. Therefore, the movable member 16 fits loosely between the ring-shaped body 13 and the shaft 20E. As a result, the ring-shaped body 13 rotates even more easily with respect to the shaft 20C than in the case of the shaft 20B.

There are no gears inside the constricted part 23E.

Furthermore, the shaft tip of the shaft 20E is pointed in a cone shape.

As a result, the top toy 100 has little frictional resistance and can rotate for a long time.

In this top toy 100 as well, it is preferable to prepare a plurality of shafts having different shaft diameters and shapes at a prescribed portion.

Second Embodiment

Figure 17:
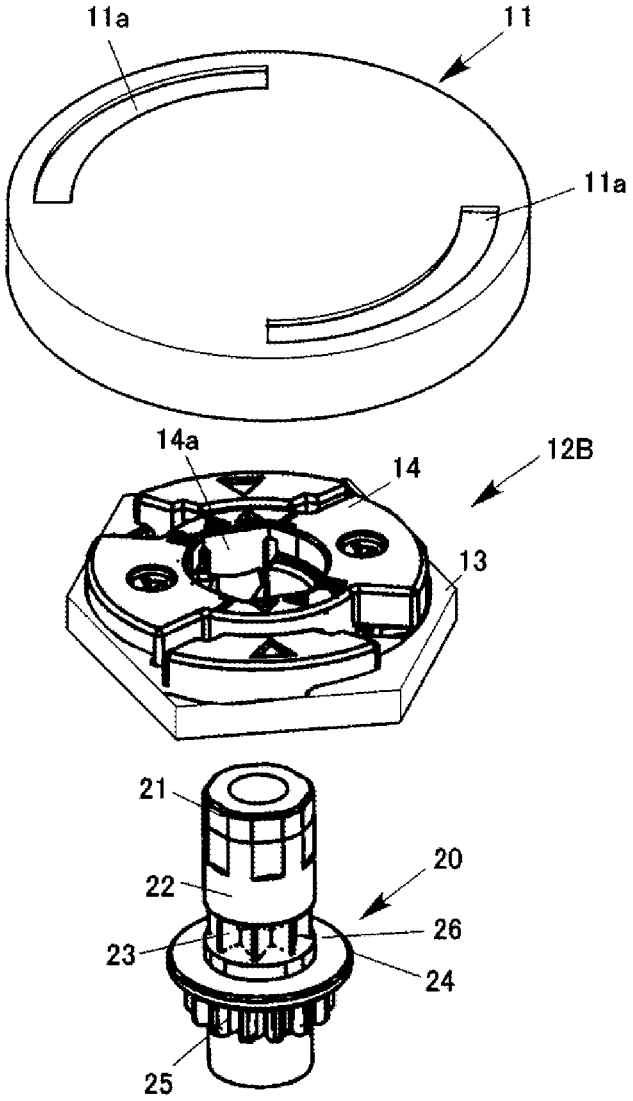
FIG. 17 is an exploded perspective view of the top toy according to a second embodiment.
Figure 18:
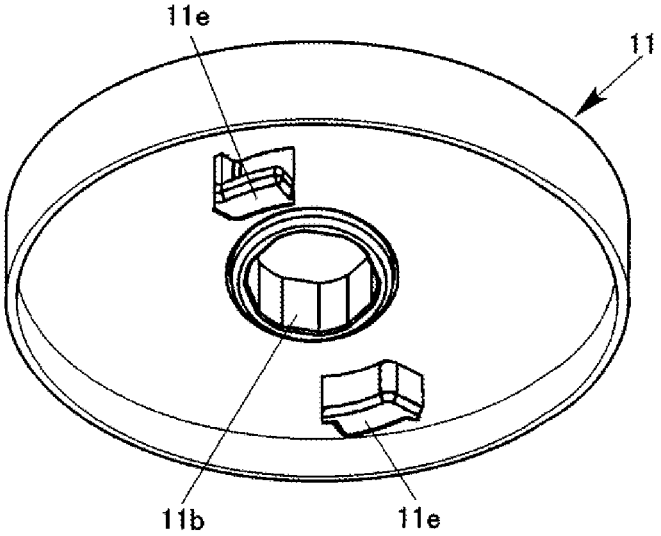
FIG. 18 is a perspective view of the upper trunk part of the top toy seen from below.

FIG. 17 is an exploded perspective view of a top toy 200 of a second embodiment, and FIG. 18 is a perspective view of the upper trunk part 11 seen from below.

In this top toy 200, the ring-shaped body 13, the upper plate 14, and the lower plate 15 of the top toy 100 according to the first embodiment are an integrated unit and constitute a lower trunk part 12B itself, and the configuration does not have the movable member 16 on the inside of the lower trunk part 12B. This top toy 200 is configured without the fitting wall 11*d* provided on the lower side of the upper trunk part 11 of the top toy 100 according to the first embodiment. Furthermore, in this top toy 200, the point that the fitting hole 11*b* formation part (fitted part) formed on the upper trunk part 11 of the top toy 100 according to the first embodiment is fixed to the upper trunk part 11 is also different from the top toy 100 according to the first embodiment.

Other than the above points, the top toy 200 is the same as the top toy 100 according to the first embodiment, and illustrations are omitted as appropriate. Regarding elements that are not illustrated, the same names and code numbers as for corresponding elements of the top toy 100 according to the first embodiment are used for explanation.

Figure 13A:
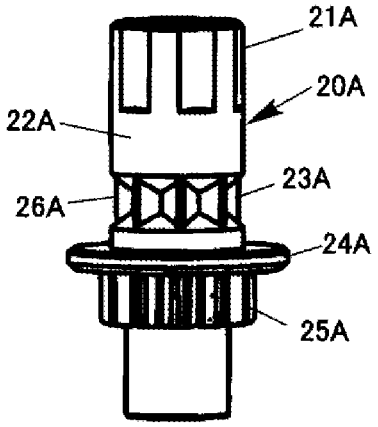
FIG. 13A is a drawing showing a shaft type.
Figure 13B:
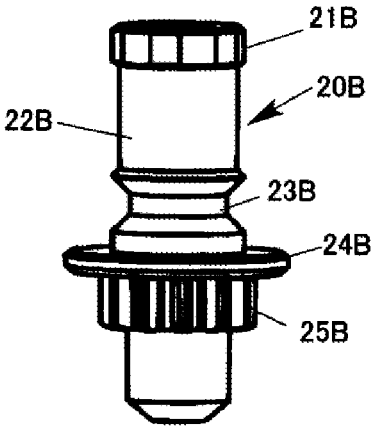
FIG. 13B is a drawing showing a shaft type.
Figure 13C:
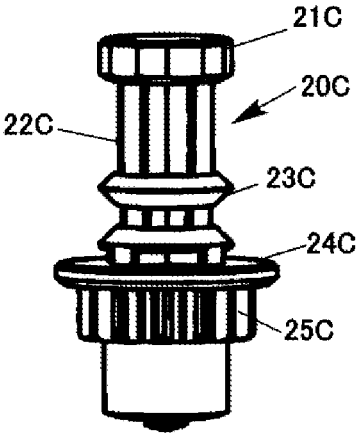
FIG. 13C is a drawing showing a shaft type.
Figure 13D:
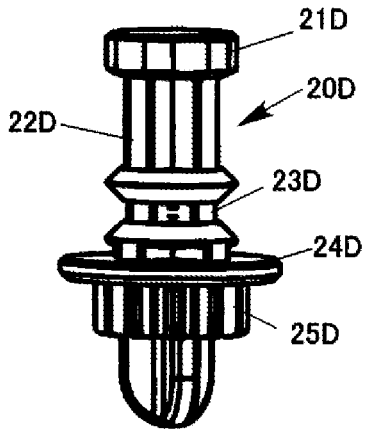
FIG. 13D is a drawing showing a shaft type.

With this top toy 200, normally the upper trunk part 11 and the shaft 20 rotate integrally, by top toys colliding with each other an external force acts on the lower trunk part 12B, and the lower trunk part 12B rotates relatively in the direction opposite to the rotation direction of the top toy 200 with respect to the upper trunk part 11 and the shaft 20. At this time, the claw (first engagement part) 14*d* of the elastic piece 14*e* in the upper plate 14 meshes with the gears 26 of the constricted part 23 of the shaft 20, so the claw 14*d* and the teeth of the gears 26 (second engagement part) slide and generate rotational resistance. When using a shaft on which the gears 26 are not formed on the constricted part 23, for example shafts 20B to 20D in FIG. 13B to 13D, compared to the case of sliding of the claw 14*d* and the teeth of the gears 26, a smaller rotational resistance occurs. That is, by exchanging the shaft, it is possible to easily perform adjustment of the difficulty of disassembly of the upper trunk part 11 and the lower trunk part 12B.

Modification Example

With the embodiments above, the shaft 20, etc., was inserted and removed from below the lower trunk part assembly 12 and the lower trunk part 12B, but it is also possible to configure so that in a state with the upper trunk part 11 and the lower trunk part assembly 12 and the lower trunk part 12B not joined, the lower trunk part assembly 12 and the lower trunk part 12B are inserted and removed from above, and to have the shaft 20, etc., fixed by the joining of the upper trunk part 11.

Also, gears 25 that mesh with the teeth 93*a* of the guide section 93 were formed, but when the teeth 93*a* of the guide section 93 are not formed, it is also possible to form the shaft 20, etc., or its surface layer using a material having high frictional resistance, or to provide a roller on the shaft 20, etc.

Furthermore, in the embodiments above, the gears 25 were provided fixed to the shaft 20, etc., but may also be provided with the ability to idly rotate with respect to the shaft 20, etc.

In the first embodiment noted above, the arc-shaped part 16*a* of the movable member 16 was abutted on each abutted part 22, etc., but it is also possible for a shaft 20, etc., of a small diameter to be included in a prescribed part to the extent that the arc-shaped part 16*a* of the movable member 16 does not abut. In this case, the configuration may be such that radially inward movement of the movable member 16 is restricted by coming into contact with the boss 15*c*, and as a result, it is possible to change the relative rotation hardness (rotational resistance) of the ring-shaped body 13 and the support body.

In the embodiments noted above, the elastic piece 14*e* that has the claw 14*d* for holding the shaft 20, etc., is provided, but it is also possible to configure so that the claw member whose tip engages with the constricted part 23, etc., is energized radially inward by a coil spring.

Furthermore, in the first embodiment noted above, the convex part 16*b* was provided in the movable member 16 and recesses 13*d*, 13*e* were provided in the ring-shaped body 13, but this may also be the opposite. The number of convex parts and recesses that fit in the machine at once is also not an issue. Furthermore, it is also possible to configure with the recesses provided continuously, with the convex parts fitted one after another in the adjacent recesses during relative rotation of the ring-shaped body 13 and the support body. The key point is that rotational resistance be constituted between the movable member 16 and the ring-shaped body 13.

In the first embodiment noted above, the convex part 16*b* was provided in the movable member 16 and recesses 13*d*, 13*e* were provided in the ring-shaped body 13, but at least one surface of the abutting surfaces of the movable member 16 and the ring-shaped member 13 may also be formed using an item with a large frictional coefficient configured from an elastic material.

Similarly, in the embodiments above, at least one surface of the abutting surfaces of the constricted part 23 and the claw 14 may be formed using an item with a large frictional coefficient.

In the first embodiment noted above, to accommodate both rotations, the convex part 16*b* was provided in the movable member 16 and recesses 13*d*, 13*e* provided in the ring-shaped body 13, but in the case of the top toy 100 with either clockwise rotation or counterclockwise rotation, as long as there is one convex part engaging mutually during rotation of the top toy 100, when engagement of the convex parts with each other is released, it is also possible to allow relative rotation between the ring-shaped body 13 and the support body.

With the first embodiment noted above, the configuration was such that it was possible for the shaft 20, etc., to rotate relatively with respect to the upper trunk part 11, but it is also possible to configure so that the formation part of the fitting hole 11*b* in which the shaft head 21 of the shaft 20, etc., is fitted is fixed to the upper trunk part 11, and the shaft 20, etc., rotates integrally with respect to the upper trunk part 11. In this case, it is not necessary to provide the gears 26, etc., on the constricted part 23, etc.

With the first embodiment noted above, the shaft head 21 of the shaft 20 has a complementary shape with the fitting hole 11*b* of the upper trunk part 11, but it is also possible to not have a complementary shape for the shaft head 21 and the fitting hole 11*b*. That is, it is sufficient provided that the shaft head 21 and the fitting hole 11*b* fit, and that the shaft 20 is held at the center of the top toy 100.

With the first embodiment noted above, the movable member 16 was configured using POM (Poly Oxy Methylene), and a structure with the ring-shaped body 13 elastically deformed and the convex part 16*b* pulled out from the recesses 13*d*, 13*e* was explained, but conversely, it is also possible to constitute the movable member 16 using an elastic material, and to use a structure in which the movable member 16 elastically deforms, or a structure in which both elastically deform and the convex part 16*b* is pulled out from the recesses 13*d*, 13*e*.

Furthermore, with the embodiments noted above, rotational resistance was made to be formed between the constricted part 23 of the shaft 20 and the claw 14*d*, but it is sufficient provided there is a part that changes rotational resistance by exchanging the shaft 20 between another location of the shaft 20 and the lower trunk part assembly 12 and the lower trunk part 12B.

According to the present invention, it is possible to easily change the difficulty of disassembly (rotational resistance or rotational hardness) by exchanging the rod-shaped shaft.

Also, in an item in which the claw and the constricted part are engaged, it is also possible to hold the rod-shaped shaft at the same time.

Modification examples were explained above, and these can be used in suitable combinations in a scope that do not mutually conflict.

INDUSTRIAL APPLICABILITY

The top toy of the present invention can be used suitably in the top toy manufacturing field.

The invention claimed is:

1. A top toy for rotating in a first direction, comprising a top part including an upper trunk part; and a bottom part including a lower trunk part and first and second rod-shaped shafts, the lower trunk part having an insertion through hole formed at a center thereof, the lower trunk is attached to the upper trunk; and the first and second rod-shaped shafts being interchangeable to each other when the first rod-shaped shaft is employed, the first rod-shaped shaft being inserted in the insertion through hole and being attached to the lower trunk, when the second rod-shaped shaft is employed, the second rod-shaped shaft being inserted in the insertion through hole and being attached to the lower trunk, when the upper trunk part is rotated relative to the lower trunk part in a second direction opposite to the first direction by an external force and when reaches a joint release position, the upper trunk part and the lower trunk part being detached, the bottom part including a first engagement part, and a second engagement part being engaged with the first engagement part at a part that rotates integrally with the upper trunk part, the first rod-shaped shaft having a first shape to create a first engagement state between the first and second engagement parts, the second rod-shaped shaft having a second shape being different from the first shape to create a second engagement state between the first and second engagement parts, the first engagement state being different from the second engagement state.

2. The top toy according to claim 1, wherein the lower trunk part is formed in a ring shape, the lower trunk part includes a support body being configured to rotate around the first rod-shaped shaft when the first rod-shaped shaft is employed, the first engagement part is formed on an inner periphery of the lower trunk part, the support body is configured to fit in a part of the upper trunk part and rotate integrally with the upper trunk part when the upper trunk part and the lower trunk part are attached, the support body includes a movable member being configured to move in a radial direction, the second engagement part is configured on the support member radially outward, a radially inward movement of the movable member is restricted on the basis of a first shaft diameter of a portion of the first rod-shaped shaft, the second rod-shaped shaft has a second shaft diameter being different from the first shaft diameter, when the first rod-shaped shaft is employed, the first rod-shaped shaft creates a rotational resistance between the upper trunk and the lower trunk, when the second rod-shaped shaft is employed, the second rod-shaped shaft creates a second rotational resistance between the upper trunk part and the lower trunk part.

3. The top toy according to claim 2, wherein one of the first engagement part and the second engagement part is a convex part, and the other is a recess.

4. The top toy according to claim 2, wherein both the first engagement part and the second engagement part are convex parts.

5. The top toy according to claim 1, wherein when the first rod-shaped shaft is employed, the first rod-shaped shaft is configured to be fitted to a part of the upper trunk part and to rotate integrally with the upper trunk part, when the second rod-shaped shaft is employed, the second rod-shaped shaft is configured to be fitted to the part of the upper trunk part and to rotate integrally with the upper trunk part, the lower trunk part includes the first engagement part, the second rod-shaped shaft includes the second engagement part, the first rod-shaped shaft includes a third engagement part having the first shape being different from the second shape.

6. The top toy according to claim 5, wherein the second engagement part is a constricted part, and the first engagement part is a claw that is fitted by elastic force on the constricted part.

7. The top toy according to claim 1, rotation characteristic of the top toy is changed by exchanging of the first rod-shaped shaft and the second rod-shaped shaft.

* * * * *